United States Patent [19]

Menikheim et al.

[11] 4,396,452

[45] Aug. 2, 1983

[54] PROCESS FOR POINT-BONDING ORGANIC FIBERS

[75] Inventors: Virginia C. Menikheim, Chapel Hill; Bernard Silverman, Raleigh, both of N.C.

[73] Assignee: Monsanto Company, St. Louis, Mo.

[21] Appl. No.: 972,185

[22] Filed: Dec. 21, 1978

[51] Int. Cl.[3] ..... B32B 31/20

[52] U.S. Cl. ..... 156/290; 156/62.6; 156/181; 156/296; 264/119; 428/198; 428/288; 428/289; 428/296

[58] Field of Search ..... 156/62.6, 181, 290, 156/296, 305, 291; 264/83, 119; 428/195, 198, 428/288, 289, 293, 296

[56] References Cited

U.S. PATENT DOCUMENTS

| | | | |
|---|---|---|---|
| 2,269,125 | 1/1942 | Quenelle et al. | |
| 2,357,392 | 9/1944 | Francis . | |
| 2,464,301 | 3/1949 | Francis . | |
| 3,236,587 | 2/1966 | Genereux | 156/305 X |
| 3,516,900 | 6/1970 | Mallonee et al. | 428/296 |
| 3,542,615 | 11/1970 | Dobo et al. | 156/305 X |
| 3,613,445 | 10/1971 | Dent et al. | 73/159 |
| 3,686,066 | 8/1972 | Peters | 428/296 |
| 3,853,659 | 12/1974 | Rhodes | 156/181 |
| 3,869,329 | 3/1975 | Schweitzer et al. | 156/308 |
| 4,035,219 | 7/1977 | Cumbers | 156/290 |
| 4,075,383 | 2/1978 | Anderson et al. | 428/198 |

FOREIGN PATENT DOCUMENTS

| | | |
|---|---|---|
| 49-3459 | 1/1974 | Japan . |
| 49-3460 | 1/1974 | Japan . |
| 49-3461 | 1/1974 | Japan . |

*Primary Examiner*—Robert A. Dawson
*Attorney, Agent, or Firm*—Thomas N. Wallin

[57] ABSTRACT

Nonwoven point-bonded fabrics of improved softness are prepared by simultaneously heating and compressing spaced, discrete areas of a nonwoven, bondable fiber web containing an attenuating bonding liquid in excess of the minimum amount required to provide maximum fabric strength.

8 Claims, No Drawings

PROCESS FOR POINT-BONDING ORGANIC FIBERS

BACKGROUND OF THE INVENTION

This invention relates to processes for bonding nonwoven webs of organic fibers to form nonwoven fabrics. More specifically, the invention relates to such processes wherein the web is preferentially bonded in spaced, discrete areas.

Nonwoven fabrics and numerous uses thereof are well known to those skilled in the art. Such fabrics are prepared by forming a web of continuous filament and/or staple fibers and bonding the fibers at points of fiber-to-fiber contact to provide a fabric of requisite strength.

Depending on the intended use of the nonwoven web, satisfactory bonding can in some instances be accomplished mechanically, e.g., by needle punching or interlacing of the fibers or by application of adhesives to the fibrous web. However, in a number of applications nonwoven fabrics bonded by autogenous fiber-to-fiber fusion are desired. Bonding of this type is in some instances obtained by the application of heat in conjunction with the use of a liquid bonding agent to soften or plasticize the fibers and render them cohesive. In such autogenous bonding techniques the web can be subjected to mechanical compression to facilitate obtaining bonds of required strength. When web fibers are bonded at essentially all points of fiber-to-fiber contact, for example, by overall compression of the web in the presence of heat and appropriate liquid bonding agent, the resultant nonwoven fabric tends to be stiff and boardly and characterized by low elongation and tear resistance. That is, such overall bonded fabrics are frequently more similar to paper than to conventional textile fabrics. In order to more closely simulate the properties of conventional textiles, nonwoven "point-bonded" fabrics have been prepared by processes tending to effect preferential bonding in spaced, discrete areas (primary bond sites). In order to provide point-bonded nonwoven fabrics of adequate strength, it is generally necessary that bonding of the web in the primary bond sites be accompanied by mechanical compression. This is generally accomplished by compressing the nonwoven web between mechanical compression means such as a pair of rollers or platens at least one of which carries bosses sized and spaced to provide the desired pattern of primary bond sites or both of which carry land and groove designs interacting to provide the desired pattern. The compression means are generally heated sufficiently to effect bonding by the liquid bonding agent. By a proper selection of sizing and spacing of the bosses or lands and grooves, choice of bonding agent and control of the bonding conditions (temperature and compressive force), it is possible to obtain nonwoven point-bonded fabrics having acceptable strength and improved tactile properties such as softness. However, even point-bonded fabrics are frequently less soft than conventional fabrics of comparable strength. This is probably due, at least in part, to "tack" bonding. When the bonding conditions are controlled to provide fabrics having good strength and durability during washing, bonding is not limited to the primary bond sites produced in the areas compressed. Varying degrees of boundary or "tack" bonding are generally observed between the primary bond sites. Such "tack" bonding probably results from the fact that techniques employed for preparing point-bonded nonwoven fabrics expose areas of the web between the areas being compressed to heat sufficient to cause the bonding agent to effect some softening and tack bonding of fibers at points of contact. The strength and number of the tack bonds formed may vary widely with the properties of the fiber utilized in the web as well as the conditions employed for effecting bonding in the primary bond sites. Desired fabric properties such as softness are progressively impaired as the degree of tack bonding is increased. There is, therefore, a need in the art for processes capable of providing softer nonwoven fabrics.

SUMMARY OF THE INVENTION

It is an object of this invention to provide processes for making point-bonded nonwoven fabrics characterized by improved softness. It is a further object of the invention to provide processes for making such fabrics having improved softness without undue reduction in fabric strength. These and other objects of the invention are obtained by simultaneously heating and compressing spaced, discrete areas of a nonwoven web which comprises bondable, synthetic, organic fibers and which contains an attenuating liquid bonding agent as hereinafter defined. The temperature, compressive force, time of exposure of the web thereto and the quantity of attenuating liquid are correlated to effect bonding and to provide fabrics of improved softness. The practice of the invention will be understood from the following description of the preferred embodiments.

DESCRIPTION OF THE PREFERRED EMBODIMENTS

The process of this invention can be utilized for making point-bonded fabrics from nonwoven webs of bondable organic fibers. The phrase "bondable organic fibers" is used herein in the specification and claims to denote fibers which can be autogenously bonded at points of fiber-to-fiber contact by the application of heat and compression as hereinafter described in conjunction with a liquid bonding agent as hereinafter defined. The fibers may be in the form of continuous filaments or staples or mixtures thereof.

Examples of bondable fibers suitable for use in the practice of this invention include polyamide fibers such as nylon 6 and nylon 66; acrylic and modacrylic polymer fibers; and polyester polymer fibers. Composite fibers such as fibers having a sheath of one polymer and a core of another polymer or side-by-side polycomponent fibers can be utilized. In the case of multicomponent fibers it is not essential that all polymer components thereof be bondable under the processing conditions hereinafter described. It is sufficient that such multicomponent fibers have bondable surface portions. If desired, the fibers can be crimped or textured to provide elasticity or other desired characteristics to the finished fabric.

In accordance with the present invention, the bondable fibers are processed in the form of nonwoven webs. The nonwoven webs of bondable organic fibers may be composed entirely of bondable fibers or, alternatively, may consist of bondable fibers interspersed with other fibers. The art of preparing nonwoven webs is well understood and the manner of web formation is not critical. Generally webs are formed by deposition of fibers on a moving belt in either random or aligned orientation to provide a web having a weight of from 4 to 400 grams per square meter, preferably 10 10 150 grams per square meter. Particularly useful methods for web formation are disclosed in U.S. Pat. No. 3,542,615, the disclosure of said patent being incorporated herein by reference.

In accordance with the present invention a selected quantity of attenuating bonding liquid is applied to the web and the web is simultaneously heated and compressed in spaced discrete areas to effect bonding of the fibers in such areas. A bonding liquid is any liquid whose presence in the web in quantities of 200% or less of the web weight prior to application of the liquid permits bonding in accordance with the process herein described at lower temperatures or lower compressive forces than those which would produce bonding in the absence of such liquid or which provides stronger bonding (as evidenced by higher strip tenacity values) at given temperatures and compressive forces than would be obtained in the absence of such liquid. In general, the bonding agents are believed to function by virtue of plasticizing or solvating action under the conditions of heat and compression employed to render the fibers cohesive. The heat and compression serve to activate the bonding agent by raising its temperature to a point where it exerts a solvating or plasticizing action and/or by evaporative concentration of bonding agent solutions to a concentration sufficiently high to exert bonding action at the temperatures and pressures involved.

As bonding liquid level in the web is increased, an increase in strip tenacity as compared to fabrics prepared using no liquid or lower quantities of liquid under otherwise equivalent conditions will be observed. As liquid level is progressively increased, strip tenacity will increase until a point is reached beyond which further increases in liquid level will produce no additional increase in strip tenacity and may even result in some decrease in strip tenacity. Such minimum quantity of bonding agent required to provide fabric of maximum fabric strip tenacity under given conditions is herein designated the "peak bonding quantity" for the web being processed under such conditions. An "attenuating bonding liquid" is a bonding liquid which if used in quantities exceeding the peak bonding quantity by no more than 400% of the web weight (prior to addition of bonding liquid) provides a nonwoven fabric having an average bending modulus at least 20% lower than that of a fabric prepared using the peak bonding quantity of liquid.

A key element of the present invention is this unexpected discovery that utilization of an attenuating bonding liquid in sufficient excess of the peak bonding quantity will provide a reduction in fabric bending modulus (i.e., an increase in fabric "softness") as compared to that of fabrics prepared using a peak bonding quantity of liquid under otherwise equivalent conditions. In accordance with the present invention a sufficient excess is employed to reduce bending modulus by at least 20%. The actual amount of attenuating bonding liquid used may be any quantity in excess of the peak bonding quantity sufficient to effect such reduction. Generally, there is no theoretical objection to use of very substantial excesses of liquid. However, it will be observed that after a determinable excess is added, the use of further excess liquid will not provide substantial additional improvements in softness and, in some instances, may tend to reduce fabric strength. Of course, excessive amounts of liquid beyond that contributing to improvement of fabric properties will present unnecessary process problems with respect to liquid handling, recovery, etc. It is preferred that the amount of liquid be chosen such that in addition to reducing bending modulus by at least 20%, a higher ratio of strip tenacity to bending modulus (as compared to that obtained using a peak bonding quantity of liquid) is obtained. That is, the maximum quantity utilized is preferably chosen so as not to reduce fabric strength disproportionately to improvements in softness obtained.

Whether or not a particular liquid will function as an attenuating bonding liquor or even as a bonding agent will depend on the nature of the nonwoven web to be bonded, the properties of the fibers constituting the web and the manner in which the web is heated and compressed. Therefore, it is not practical to exhaustively list all combinations of liquids, fibrous webs, and conditions of temperature and compression suitable for the practice of the present invention. For example, water will not effectively improve the bonding of a web of nylon fibers lightly compressed in spaced, discrete areas at temperatures below that required to cohesively soften an otherwise identical dry web. However, if sufficient water is present and the compressive force is sufficiently high effective bonding can be obtained at lower temperatures. Further addition of water in excess of a peak bonding quantity will substantially improve fabric softness. Thus, the effectiveness of a particular liquid as an attenuating bonding liquid under given bonding conditions can readily be determined by routine tests.

It is believed that attenuating bonding liquids provide softening by limiting (for example by evaporative cooling, heat capacity, etc.) the temperatures attained in the web in areas not being simultaneously heated and compressed as hereinafter described. The heat attenuation provided by the liquid is believed to limit or prevent tack bonding outside the discrete, spaced areas which are heated and compressed, thereby providing a softer fabric. Thus in selecting liquids for testing preference may be given to those which do not effect cohesive softening of the fibers to be bonded at ambient temperatures encountered by the web prior to heating and compression. In general, any bonding liquid which, at atmospheric pressure, will not effect bonding at temperatures equal to or below its boiling point will be an effective attenuating bonding liquid. A number of liquids capable of effecting bonding at temperatures below their atmospheric boiling point will also be effective, however, presumably due to heat attenuation resulting from heat capacity, vaporization, etc. preventing the liquid from reaching bonding temperatures in the uncompressed areas when sufficient excess is employed.

Under properly correlated simultaneous application of heat and compression to appropriate nonwoven webs, examples of liquids contemplated to be suitable attenuating bonding liquids for polyamide fibers include water, dilute aqueous hydrochloric acid; examples of contemplated suitable attenuating bonding liquids for acrylic and modacrylic fibers include aqueous propylene carbonate or sulfolane (tetrahydrothiophane-1,1 dioxide); and examples of suitable attenuating bonding liquids for polyester fibers include methylene chloride; methyl ethyl ketone; 2-pentone, the latter two liquids being particularly suited for less crystalline fiber forms.

In accordance with this invention, the nonwoven web containing the attenuating bonding liquid is simultaneously heated and compressed in spaced, discrete areas (points) to effect fiber bonding in such areas thereby forming the web into a point-bonded fabric.

Simultaneous heating and compression of the web in spaced, discrete areas can readily be accomplished by compressing the webs between a pair of compressing means such as rolls or platens at least one of which compression means is heated. Further, one or both of the compression means will have bosses or a land and groove design or combinations thereof such that compression of the web will be effected in spaced, discrete areas rather than overall. In order to provide adequate overall physical properties it is generally desirable that from 2% to 80%, preferably 3% to 50%, most preferably 5% to 30%, of the total surface area of the web be subjected to compression. Further, the number of spaced, discrete bond sites per square centimeter generally should be from 1 to 250, preferably from 16 to 64.

The compressive force, the temperature, and the time of exposure of the web to compression and heating will depend on the nature and quantity of the attenuating bonding liquid utilized and the nature of the fibers being processed. Therefore, for a particular nonwoven web and a particular attenuating bonding liquid, the compressive force, the temperature, and the time of exposure of the web to the compressive force and heating will be correlated to effect bonding of the web fibers in the heated, compressed areas.

Preferably, the heating and compression will be correlated to effect a degree of bonding sufficient to provide a wash stable fabric as hereinafter defined. In general, increases in bonding will be observed with increased temperature until a temperature is attained beyond which further increases will have little, if any, beneficial effect. If the operation is conducted at too high a temperature, the heat attenuation characteristics of the liquid may not be adequate to provide requisite improvements in fabric softness. The optimum correlation of temperature and compressive force can, of course, be empircally determined by routine tests.

The following examples will facilitate a better understanding of the invention and the desirable properties of fabrics produced thereby. The tests described below are used to determine fabric properties as reported in the examples or otherwise referred to in the specification and claims:

Strip Tenacity

Strip Tenacity is used as an indicator of fabric strength and is determined by dividing the breaking load of a cut fabric strip (as determined by American Society of Testing Materials procedure D-1682-64) by the fabric basis weight. Strip Tenacity is expressed as $g/cm/g/m^2$, Values reported are an average of tenacities in the machine and transverse directions of the fabric. (The machine direction corresponds to the direction of feed to the heating and compressing means and the transverse direction is the planar direction at a right angle thereto.)

Bending Modulus

Bending Modulus is used as a measure of fabric softness and is determined in accordance with techniques as described in U.S. Pat. No. 3,613,445, the disclosure of which is incorporated herein by reference. In accordance with such disclosure a test fabric is forced vertically downward through a slot at a constant speed. A signal is generated in proportional response to the load incurred in moving the fabric into and through a slot. A load-extension curve is generated by plotting the signal as a function of the distance. Hand, drape and bending modulus are determined by analyzing the load-extension curve. Hand is represented by the maximum point on the load-extension curve. Drape is represented by the slope of the load-deflection curve and bending modulus is determined by dividing the drape value by the cube of fabric thickness. Bending Modulus, as determined on a $10.6 \times 10.6$ cm sample, is expressed in $gm/cm^4$ and values reported are an average of fabric face up and face down machine and transverse direction measurements.

With respect to both Strip Tenacity and Bending Modulus, the requirements of the present invention are defined in terms of relative (percent change; ratios) rather than absolute values. Accordingly, apparatus calibrations and choice of test techniques are not critical so long as reasonable consistency is maintained in a given series of comparative tests.

Since individual measurements are affected by variations in fabric uniformity and inherent limitations in the precision of various measuring techniques, it is important to conduct and average sufficient measurements to statistically assure that the difference in values of bending modulus and strip tenacities being compared fairly reflect differences in fabric properties as opposed to imprecisions in measurements or imperfect fabric uniformity.

Wash Stability

Wash stability is determined as follows: Nonwoven fabric samples are mixed with at least 10 pieces of hemmed cotton sheeting each measuring about 91 cm$\times$91 cm. The number and size of the nonwoven fabric samples are subject to the following constraints:

1. Total area of the nonwoven samples is less than 6.5 $m^2$.
2. Each sample is at least 465 $cm^2$ in area with a minimum dimension of 15 cm.
3. No sample is larger than 0.929 $m^2$ in area or more than 0.305 m in its maximum dimension.

In addition, the total weight of the cotton sheeting plus the nonwoven samples should not exceed about 1.8 kg. (These constraints assure comparable results).

The load is washed in a Kenmore Model 76431100 washing machine (marketed by Sears Roebuck & Co.) using the "normal" cycle (14 min.) "Hi" water level (55 l), HOT WASH, WARM RINSE (water temperatures of 60° C.+3', 49° C.±3°) and 90 g of American Association of Textile Colorists and Chemists Standard Detergent 124.

The wash load is then dried in a Kenmore electric dryer, Model 6308603 (marketed by Sears, Roebuck & Co.) for at least 30 minutes (or longer if required to dry the entire load). The test specimens are then evaluated by visual observation to determine the number of pills formed. A pill is a visually discernible (usually roughly spherical) tangle of fiber, or fiber plus extraneous material, extending above the surface of a fabric and connected to the body of the fabric by one or more filaments. A fabric is considered to fail the test when 5 or more pills are observed in any 929 square centimeters surface area or when more severe physical deterioration is visually discernible. Fabrics passing the above test are considered "wash-stable." In the test described, the pills are predominantly formed by fibers which were not bonded in the process or which, in test procedure, were freed from bond sites. Thus the degree of pilling provides a measure of the efficacy of the process for forming bonds and a measure of the resulting bond integrity. In instances of very poor bonding more severe fabric deviation than pilling, e.g., complete disintegration, may be observed. As a practical matter, fabrics which do not pass the test (even if not totally or partially disintegrated in the test) will not withstand substantial physical stress or repeated washings without excessive deterioration.

EXAMPLE 1

Nonwoven webs composed of continuous filament, 28% crystalline polyethyleneterephthalate fibers and having a web weight of 57.6 gms/m$^2$ are immersed in methylene chloride and blotted to provide webs containing the add-on percentages of methylene chloride (weight of methylene chloride/dry weight of web×100%) shown in Table 1 below. The webs are simultaneously heated and compressed in spaced, discrete areas by passage at a speed of 0.6 meters/minute between a pair of rolls each having a helical pattern of 50 mm wide lands and 127 mm wide grooves disposed at a 45° angle to the roll axis and cooperating to produce a pattern of diamond shaped depressions covering 8.1% of the web surface. The rolls are maintained at a temperature of 195° C. and exert a compressive force of 144.6 kg/linear cm on the web (calculated based on the assumption that all compressive force is exerted at points where the web is compressed between opposing lands). Properties of the fabrics obtained are shown in Table 1 below.

TABLE 1

| Test No. | Methylene Chloride (% add-on) | Bending Modulus (gms/cm$^4$ × $10^{-5}$) | Strip Tenacity (gm/cm/gm/m$^2$) | Strip Tenacity / Bonding Modulus |
|---|---|---|---|---|
| 1 | none | 28.5 | 17.9 | .63 |
| 2 | 16.3 | 26.1 | 39.9 | 1.53 |
| 3 | 29.6 | 35.4 | 42.6 | 1.20 |
| 4 | 135 | 14.1 | 34.7 | 2.46 |
| 5 | 185 | 10.0 | 33.7 | 3.37 |
| 6 | 237 | 8.1 | 31.0 | 3.83 |
| 7 | 251 | 7.6 | 34.7 | 4.57 |
| 8 | 318 | 7.9 | 33.7 | 4.27 |

Inspection of the above data shows that the use of methylene chloride provides fabrics having substantially increased strip tenacity as compared to fabrics prepared under otherwise identical conditions without the use of methylene chloride. Thus, for the web and conditions employed in the present example, methylene chloride is considered a bonding agent. Further, it appears that the peak bonding quantity of methylene chloride is about 30% add-on. A reduction of bending modulus substantially greater than 20% (as compared to bending modulus determined for fabric produced using a peak bonding quantity of methylene chloride) is obtained with the use of less than 400% additional methylene chloride add-on beyond the peak bonding quantity. Thus, under the conditions involved, methylene chloride is considered an attenuating bonding liquid and under the conditions of the example provides preferred advantages of the invention (lower bending modulus and a higher ratio of strip tenacity to bending modulus) at least in add-on quantities of from 135 to 318 weight percent.

EXAMPLE 2

Nonwoven webs composed of continuous filament nylon 6,6 fibers and having a web weight of 67.8 gms/m$^2$ are allowed to achieve equilibrium (about 3% water content) at 25° C. and 50% relative humidity. Water is sprayed as a fine mist onto both sides of the webs to provide webs containing the add-on percentages of water $$\left(\frac{\text{weight water sprayed on}}{\text{equilibrium web weight}} \times 100\%\right)$$

shown in Table 2 below. The webs are simultaneously heated and compressed in spaced, discrete areas by passage at a speed of 0.3 meters per minute between a pair of metal rolls. One roll is smooth while the other has 28 square boss sites/cm$^2$ aligned in a square pattern covering about 18% of the surface area of the roll. The pressure at the roll nip is calculated as 68.9 kg/cm (assuming all pressure to be applied only to the boss sites). Both rolls are heated to a temperature of 188° C. Properties of the fabrics obtained are shown in Table 2 below.

TABLE 2

| Test No. | Water (% add-on) | Bending Modulus (gms/cm$^4$ × $10^{-5}$) | Strip Tenacity (gm/cm/gm/m$^2$) | Strip Tenacity / Bonding Modulus |
|---|---|---|---|---|
| 1 | 0 | 13.0 | 11.6 | .89 |
| 2 | 2.8 | 12.9 | 36.8 | 2.85 |
| 3 | 6.6 | 11.5 | 41.0 | 3.57 |
| 4 | 15.0 | 10.5 | 50.5 | 4.81 |
| 5 | 19.6 | 10.2 | 46.3 | 4.53 |
| 6 | 29.8 | 6.8 | 47.9 | 7.04 |
| 7 | 42.8 | 6.9 | 45.2 | 6.55 |
| 8 | 66.0 | 7.7 | 46.3 | 6.01 |
| 9 | 75.6 | 7.9 | 49.4 | 6.25 |

Inspection of the above data shows that the use of water provides fabrics having substantially increased strip tenacity as compared to fabrics prepared under otherwise identical conditions without the use of water. Thus, for the web and conditions employed in the present example, water is considered a bonding agent. Further, it appears that the peak bonding quantity of water is about 15% add-on. A reduction of bending modulus substantially greater than 20% (as compared to bending modulus determined for fabric produced using a peak bonding quantity of water is obtained with the use of less than 400% additional water add-on beyond the peak bonding quantity. Thus, under the conditions involved, water is considered as attenuating bonding liquid and provides preferred advantages of the invention at least in add-on quantities of from about 29%–75%.

The foregoing description of the preferred embodiments and examples will enable those skilled in the art to practice these and all other embodiments of the invention within the scope of the appended claims.

What is claimed is:

1. A process for making a point-bonded nonwoven fabric, said process being characterized by simultaneously heating and compressing spaced, discrete areas of a nonwoven web of bondable, synthetic, organic fibers, said web containing an attenuating bonding liquid, said liquid being a liquid which, under the bonding conditions employed, provides a fabric having higher strip tenacity than obtained in the absence of such liquid under otherwise equivalent conditions and which, when employed in excess of a peak bonding quantity, provides fabric of lower bending modulus than obtained using a peak bonding quantity under otherwise equivalent conditions, and the quantity of said liquid, the temperature, the compressive force and the time of exposure of the web thereto being correlated to effect bonding of web fibers in said spaced, discrete areas, thereby forming a point-bonded nonwoven fabric and the quantity of said liquid being sufficiently in excess of the peak bonding quantity thereof to provide a nonwoven fabric having a bending modulus at least 20% lower than that of a fabric prepared using a peak bonding quantity of said liquid under otherwise equivalent conditions.

2. The process of claim 1 further characterized in that the quantity of said liquid is selected to provide a nonwoven fabric having a higher ratio of strip tenacity to bending modulus than that of a fabric prepared using a peak bonding quantity of said liquid under otherwise equivalent conditions.

3. The process of claim 2 further characterized in that the quantity of said liquid, the temperature, the compressive force and the time of exposure of the web thereto are correlated to provide a wash-stable, point-bonded, nonwoven fabric.

4. The process of claim 3 further characterized in that simultaneous heating and compression of the web is effected by passing the web through and compressing said web in the nip of a pair of rolls at least one of which is heated and at least one of which has a pattern of raised surface portions which, in combination with the opposing surface of the other roll, effects compression of the web in spaced, discrete areas.

5. The process of claim 4 further characterized in that the surfaces of said rolls are designed to effect compression providing a point-bonded, nonwoven fabric having a pattern of from 16 to 64 discrete bond sites per square centimeter covering from 3% to 50% of the fabric surface area.

6. The process of claim 5 further characterized in that one of the rolls is provided with boss points sized and disposed to provide a fabric having said pattern.

7. The process of claim 5 further characterized in that each roll has a helical land and groove surface design interacting with the land and groove design of the opposing roll to provide a fabric having said pattern.

8. The process of claim 5 further characterized in that said web comprises continuous filament nylon fibers and said attenuating bonding liquid is water.

* * * * *